US005329914A

United States Patent [19]

Togai et al.

[11] Patent Number: 5,329,914

[45] Date of Patent: Jul. 19, 1994

[54] CONTROL DEVICE FOR INTERNAL COMBUSTION ENGINE

[75] Inventors: Kazuhide Togai, Takatsuki; Tetsurou Ishida, Kyoto, both of Japan

[73] Assignee: Mitsubishi Jidosha Kogyo Kabushiki Kaisha, Tokyo, Japan

[21] Appl. No.: 949,880

[22] PCT Filed: Mar. 30, 1992

[86] PCT No.: PCT/JP92/00389

§ 371 Date: Dec. 31, 1992

§ 102(e) Date: Dec. 31, 1992

[87] PCT Pub. No.: WO92/17696

PCT Pub. Date: Oct. 15, 1992

[30] Foreign Application Priority Data

Mar. 28, 1991 [JP] Japan ..... 3-064683

[51] Int. Cl.[5] ..... F02D 41/14; F02D 41/22

[52] U.S. Cl. ..... 123/688

[58] Field of Search ..... 123/688, 690, 479

[56] References Cited

U.S. PATENT DOCUMENTS 4,502,443 3/1985 Hasegawa et al. ..... 123/688
5,048,490 9/1991 Nakaniwa ..... 123/688

FOREIGN PATENT DOCUMENTS 59-023046 2/1984 Japan .
59-101562 6/1984 Japan .
60-252134 12/1985 Japan .
61-0343331 2/1986 Japan .
62-096755 5/1987 Japan .
1-138335 5/1989 Japan .
1-211638 8/1989 Japan .
1-2116338 8/1989 Japan .

*Primary Examiner*—Andrew M. Dolinar

[57] ABSTRACT

A control device for an internal combustion engine detects the air fuel ratio of the internal combustion engine at a condition with high accuracy and responsibility. Accordingly, improvement of the fuel consumption of the engine, improvement of the power of the engine, and improvement of the exhaust gas are achieved. The control device for an internal combustion engine calculates, in turn, a first air fuel ratio based on the fuel injection suction, a second air fuel ratio at the time when the gas is reached to the large area air fuel ratio sensor, and a third air fuel ratio at the time when the large area air fuel ratio sensor detects the air fuel ratio, according to the fuel amount calculated with respect to the difference between the sensed air fuel ratio and the objective air fuel ratio, to judge a jam of the large area air fuel ratio sensor by comparing the third air fuel ratio with the sensed air fuel ratio. Thus, the jam judgment is carried out in consideration with the fuel transportation lag, the transportation lag of the gas, and the response delay inherent to the large area air fuel ratio sensor. Accordingly, a highly accurate control for the air fuel ratio can be achieved.

16 Claims, 8 Drawing Sheets

CONTROL DEVICE FOR INTERNAL COMBUSTION ENGINE

TECHNICAL FIELD

This invention relates to a control device for controlling a fuel injector in an internal combustion engine and, more particularly, to a control device for an internal combustion engine which detects sensed air fuel ratio signals by an air fuel ratio sensor, calculates a set air fuel ratio by which the difference can be eliminated between the sensed air fuel ratio and an objective air fuel ratio determined depending on driving conditions, and actuates a fuel injection valve at a fuel injection amount corresponding to the set air fuel ratio.

BACKGROUND ART

In a fuel injecting device of the internal combustion engine, it is necessary to supply the fuel depending on the driving conditions of the engine. Particularly, the air fuel ratio should be restricted within a narrow window area around a stoichio by this device in order to highly and effectively employ a three way catalyst converter for purifying the exhaust gas. It is also necessary to maintain the air fuel ratio at a certain objective value around the stoichio.

On the other hand, an air fuel ratio required for the internal combustion engine differs depending on its load and engine speed, and, for example, as shown in FIG. 10, it is preferable to set the objective air fuel ratio in accordance with the load in the areas, such as a fuel cut area, a lean area, the stoichio area, and a power area. Particularly, in order to accommodate low fuel consumption, a lean burn engine has been developed which can be generally driven within the lean area.

An internal combustion engine carries out feedback control that detects sensed air fuel ratio signals over a wide range by an air fuel ratio sensor, calculates a set air fuel ratio by which the difference can be eliminated between the sensed air fuel ratio and an objective air fuel ratio determined depending on the driving conditions, and actuates a fuel injection valve in order to secure a fuel injection amount corresponding to the set air fuel ratio, thereby adjusting the air fuel ratio at the objective air fuel ratio over a wide range.

For driving the internal combustion engine in a manner described above, it is very important to precisely control the air fuel ratio into the objective value with respect to improvement of the fuel consumption, improvement of the engine power, stabilization of the idling rotation, improvement of the exhaust gas, and improvement of drivability. Thus, it is desired to improve reliability and stability of detected values of a large area air fuel ratio sensor.

Now, problems to be solved by the present invention are as follows:

That is, to judge a jam or a trouble is important for improving the reliability and the stability of the large area air fuel ratio sensor (LAFS). Generally, an output of the sensor may be varied from around 0 (v) to a sensor supply voltage Vs, and may be kept at an intermediate voltage on jamming. Thus, it is difficult to diagnose a sensor jamming merely on the basis of an output range on judging the jam of the large area air fuel ratio sensor.

Accordingly, it has been proposed to calculate the set air fuel ratio in order to eliminate a deviation between the objective air fuel ratio and the sensed air fuel ratio, thereby carrying out jam judgment for the large area air fuel ratio sensor under the set driving condition of the engine in accordance with the sensed air fuel ratio, the set air fuel ratio, and the deviation therebetween.

However, such a conventional method yields a lag between an air fuel ratio setting time and an air fuel ratio measuring time due to, for example, a transporting process of the fuel injected in an intake path of the engine, a process lag and a detection lag of the sensor. Thus, when the sensor output is simply compared with the sensed air fuel ratio in such manner, there is a defect that the sensor jam judgment will be roughly made in spite of the engine being driven in a constant condition, and it is impossible to correctly judge the sensor jam.

Accordingly, a primary object of the present invention is to provide an air fuel ratio control device for an internal combustion engine which accurately judges a jam of the large area air fuel ratio sensor to improve the reliability of the sensor detected value as well as to provide an air fuel ratio control device for an internal combustion engine which enables the air fuel ratio control to be carried out precisely.

DISCLOSURE OF THE INVENTION

A control device for an internal combustion engine according to an embodiment of the present invention consists of objective air fuel ratio calculating means for calculating an objective air fuel ratio depending on driving conditions; a large area air fuel ratio sensor disposed in an exhaust system; fuel amount calculating means for calculating fuel amount in accordance with a difference between a sensed air fuel ratio detected by the large area air fuel ratio sensor and the objective air fuel ratio; controlling means for supplying an actuating instruction signal to a fuel injector depending on the fuel amount; air fuel ratio estimating means comprising a first estimating unit for estimating a first air fuel ratio at a time of suction in consideration with a fuel transportation lag, a second estimating unit for estimating a second air fuel ratio at a time when the gas is arrived to the large area air fuel ratio sensor in consideration with a transportation lag of the gas during the process of the engine, and a third estimating unit for estimating a third air fuel ratio at a time when said sensor detects the air fuel ratio is consideration with a response lag which in inherent to the large area air fuel ratio sensor; and sensor jam judging means for judging a jam of the large area air fuel ratio sensor by comparing the third air fuel ratio with the sensed air fuel ratio.

In addition, the sensor jam judging means in this control device for the internal combustion engine may comprise a deviation calculating unit for calculating a deviation between the third air fuel ratio and the sensed air fuel ratio; a large and small judging unit for judging whether the deviation is larger or smaller than a predetermined value; a deviation integrating unit for integrating values corresponding to the deviation; an integrated value processing unit for clearing an integrated value of the deviation when a condition where the deviation is smaller than the predetermined value lasts over a predetermined time interval; and a jam judging unit for judging a jam of the large area air fuel ratio sensor when the integrated value exceeds a predetermined value.

Such a control device for an internal combustion engine enables judging the jam of the large area air fuel ratio sensor by comparing the sensed air fuel ratio with the third air fuel ratio obtained in consideration with the fuel transportation lag, the gas transportation lag and the response lag inherent to the sensor. Accordingly, the reliability for jam judgment of the large area air fuel sensor will be improved and precise air fuel ratio control can be made.

In particular, when the sensor jam judging means is comprised of the large and small judging unit, the deviation integrating unit, the integrated value processing unit and the jam judging unit, the jam of the large area air fuel ratio sensor is judged only when the integrated value of the deviation between third air fuel ratio and the sensed air fuel ratio exceeds the predetermined value. Accordingly, the stability and reliability for jam judgment of the large area air fuel ratio sensor is more improved and precise air fuel ratio control can be made.

BRIEF DESCRIPTION OF THE DRAWINGS

FIG. 9 (*b*) shows a characteristic curve of an excess air ratio calculating map for use in over the calm acceleration on the air fuel ratio control carried out by the device illustrated in FIG. 1.

PREFERRED EMBODIMENTS OF THE PRESENT INVENTION

Figure 1:
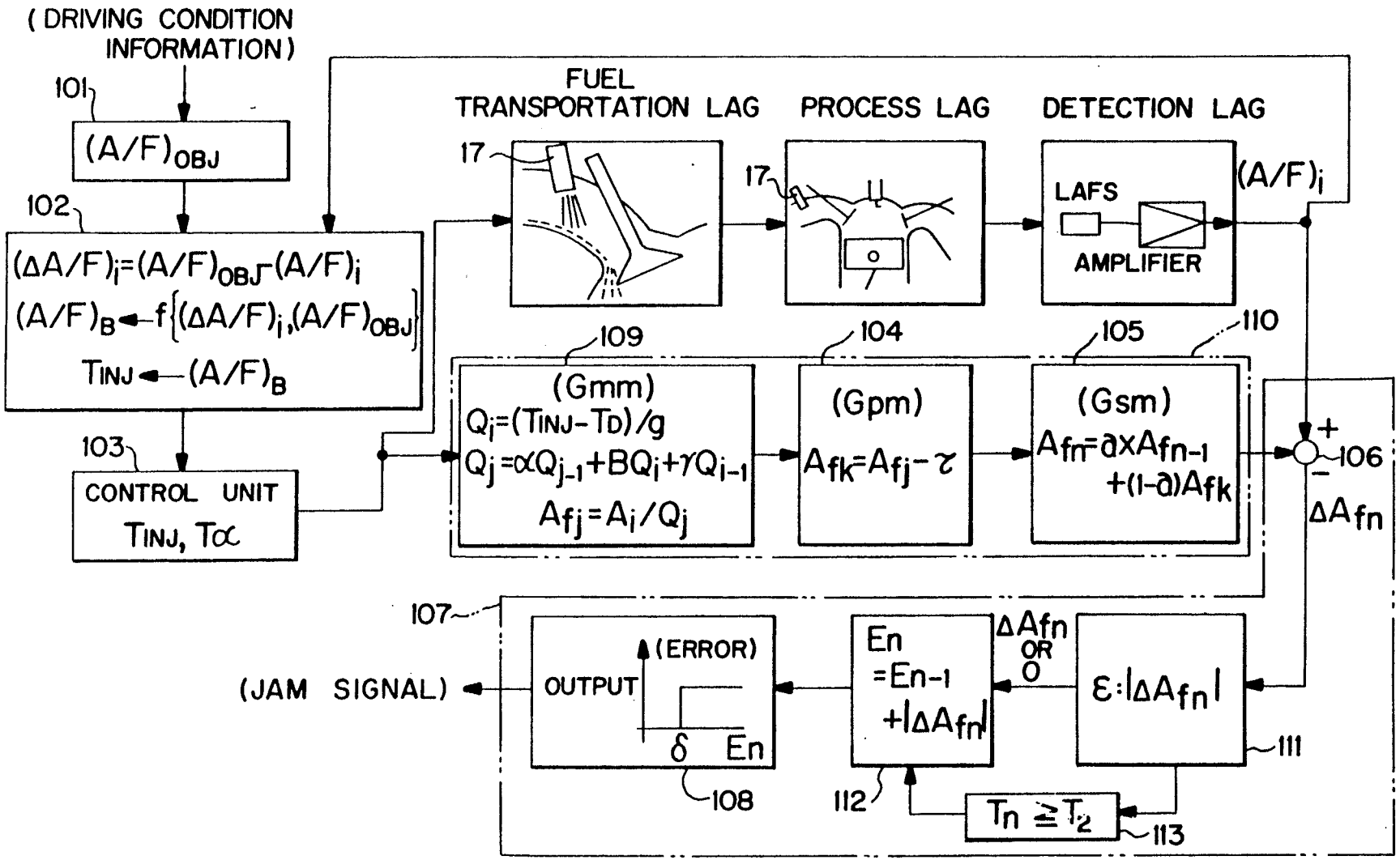
FIG. 1 is a functional block diagram of an electronic control device in a control device for an internal combustion engine according to one embodiment of the present invention.
Figure 2:
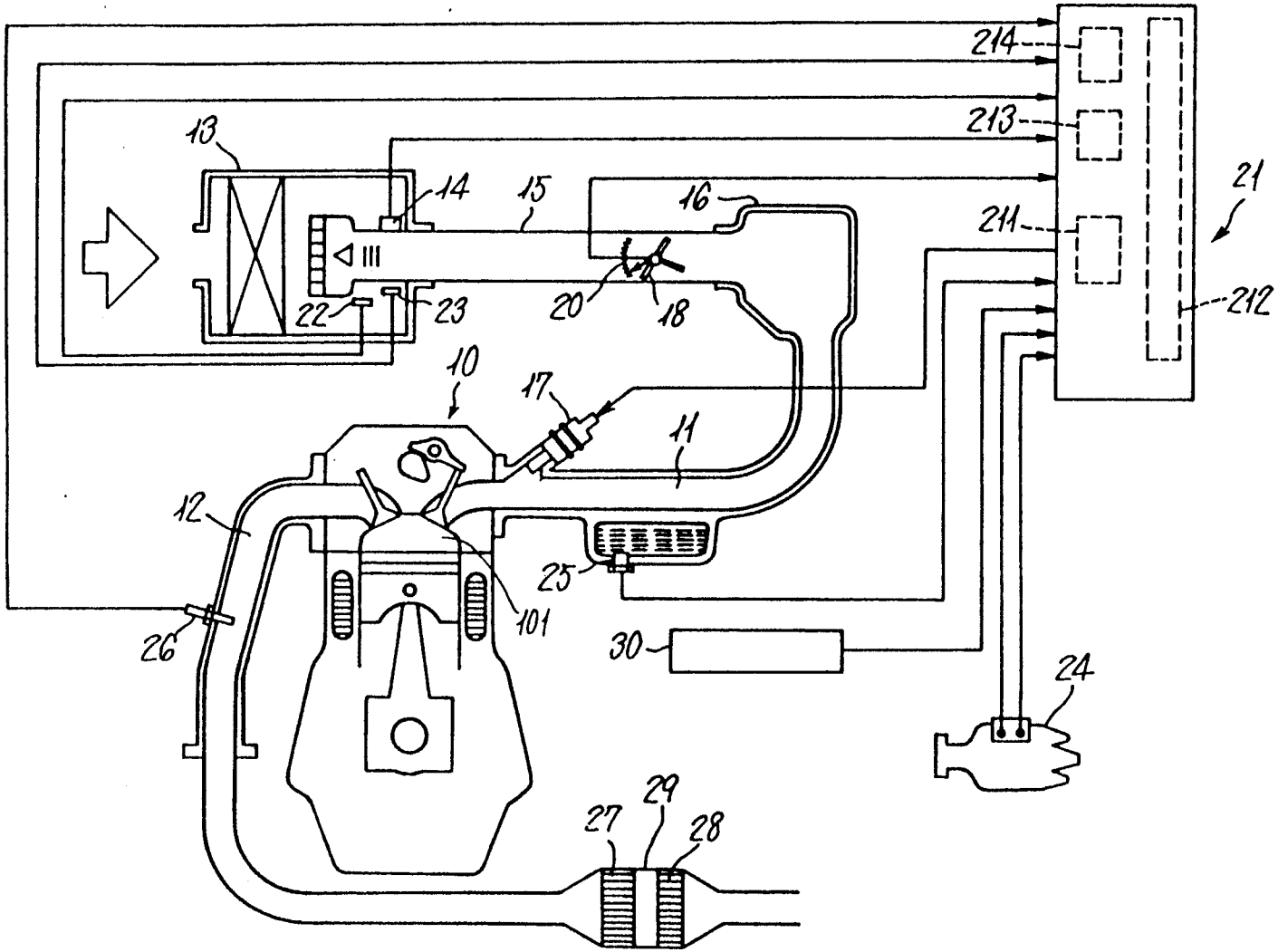
FIG. 2 is a whole structural view of the control device for the internal combustion engine illustrated in FIG. 1.

A control device for an internal combustion engine illustrated in FIGS. 1 and 2 is disposed in a control system of a fuel supply system of the internal combustion engine. The control device for the internal combustion engine calculates a fuel supply amount according to air fuel ratio (A/F) information obtained by a large area air fuel ratio sensor 26 arranged in an exhaust path of an engine 10. The fuel of this supply amount is injected in a suction path 11 at a suitable time by a fuel injection valve 17.

The engine 10 is connected to the suction path 11 and the exhaust path 12. The suction path 11 delivers air supplied from an air cleaner 13 of which air flow is sensed by an air flow sensor 14 to a combustion chamber 101 of the engine through a suction pipe 15. A surge tank 16 is disposed within the suction path 11 and the fuel is injected at a downstream thereof by the fuel injection valve 17 supported by the engine 10.

The suction path 11 is opened and closed by a throttle valve 18. The throttle valve 18 is attached with a throttle sensor 20 which produces opening information of this throttle valve 18. A voltage valve detected by this throttle sensor 20 is supplied to an input/output circuit 212 of an electronic control device 21 through an A/D converter which is not shown.

In this embodiment, a reference numeral 22 represents an atmospheric temperature sensor which produces atmospheric pressure information, a reference numeral 23 represents an intake air temperature sensor and a reference numeral 24 represents a crank angle sensor which produces crank angle information for the engine 10. In this embodiment, the crank angle sensor 24 is used as the engine speed sensor (Ne sensor). A reference numeral 25 represents a water temperature sensor which produces water temperature information of the engine 10.

The large area air fuel ration sensor 26 is disposed in the exhaust path 12 of the engine 10. The large area air fuel ratio sensor 26 supplies sensed air fuel ratio $(A/F)_i$ information to the electronic controlled device 21. In addition, downstream of the large area air fuel ratio sensor 26 in the exhaust path 12, a lean NOx catalyst converter 27 and a three way catalyst converter 28 are arranged in this order. Downstream of a casing 29 thereof, a muffler, which is not shown, is attached.

The three way catalyst converter 28 enables oxidizing and reducing HC, CO, and NOx if the exhaust gas is in a window area around the stoichio as the catalytic activity temperature is achieved. On the other hand, the lean NOx catalyst converter 27 enables reducing NOx with excess air, so that the NOx purification rate ($\eta$NOX) is higher with the larger HC/NOx ratio.

The input/output circuit 212 of the electronic control device 21 is supplied with output signals from these sensors such as the large area air fuel ration sensor 26, the throttle sensor 20, the engine speed sensor 24, the air flow sensor 14, the water temperature sensor 25, the atmospheric pressure sensor 22, the intake air temperature sensor 23, and a battery voltage sensor 30.

The electronic control device 21 serves as an engine control unit which is mainly implemented by a microcomputer. The electronic control device 21 stores detected signals of each sensor, carries out calculating according to each sensed output, and supplies control output corresponding to each control to a driving circuit 211 for driving the fuel injection valve 17, a driving circuit (not shown) for driving an ISC valve which is not shown, and to a control circuit 214 for drivingly controlling an ignition circuit (not shown). In addition, the electronic control device 21 includes, except for the aforementioned driving circuit 211 and the input/output circuit 212, a memory circuit 213 for memorizing control programs illustrated in FIGS. 4 through 8 and each set value illustrated in FIG. 1 or the like.

Functions of the electronic control device 21 on air fuel ratio control will be described below with reference to FIG. 1.

The electronic control device 21 includes an objective air fuel ratio calculating unit 101 for calculating an objective air fuel ratio $(A/F)_{OBJ}$ depending on a driving condition of the internal combustion engine; an injection calculating unit 102 for calculating a deviation air fuel ratio $(\Delta A/F)_i=(A/F)_{OBJ}-(A/F)_i$, which is equivalent to a deviation between the objective air fuel ratio $(A/F)_{OBJ}$ and a sensed air fuel ratio $(A/F)_i$, calculating a set air fuel ratio $(A/F)_B$ according to the deviation air fuel ratio $(\Delta A/F)_i$ and the objective air fuel ratio $(A/F)_{OBJ}$, and calculating a set injection amount $Q_{INJ}$ corresponding to the set air fuel ratio $(A/F)_B$; a controlling unit 103 for drivingly controlling the fuel injection valve 17 during an injection time interval $T_{INJ}$ corresponding to the set injection amount $Q_{INJ}$; an air fuel ratio setting unit 110 including a first estimating unit 109 for estimating a first air fuel ratio $Af_j$ at a time of suction in consideration with a fuel transportation lag between the fuel injection and the suction in response to the injection time interval $T_{INJ}$ and a reference injection time interval $T\alpha$ in the stoichio, stored as the operational instruction signals, a second estimating unit 104 for estimating a second air fuel ratio $Af_k$ at a time when the gas is arrived to the large area air fuel ratio sensor 26 in consideration with a transportation lag of the gas between the process of the engine according to the first air fuel ratio sensor $Af_j$, and a third estimating unit 105 for estimating a third air fuel ratio $Af_n$ at a time when the large area air fuel ratio sensor 26 detects the air fuel ratio in consideration with a response lag which is inherent to the large area air fuel ratio sensor 26 according to the second air fuel ration $Af_k$; and a sensor jam judging unit 107 for judging a jam of the large area air fuel ratio sensor 26 by comparing the third air fuel ratio $Af_n$ with the sensed air fuel ratio $(A/F)_i$.

Figure 3:
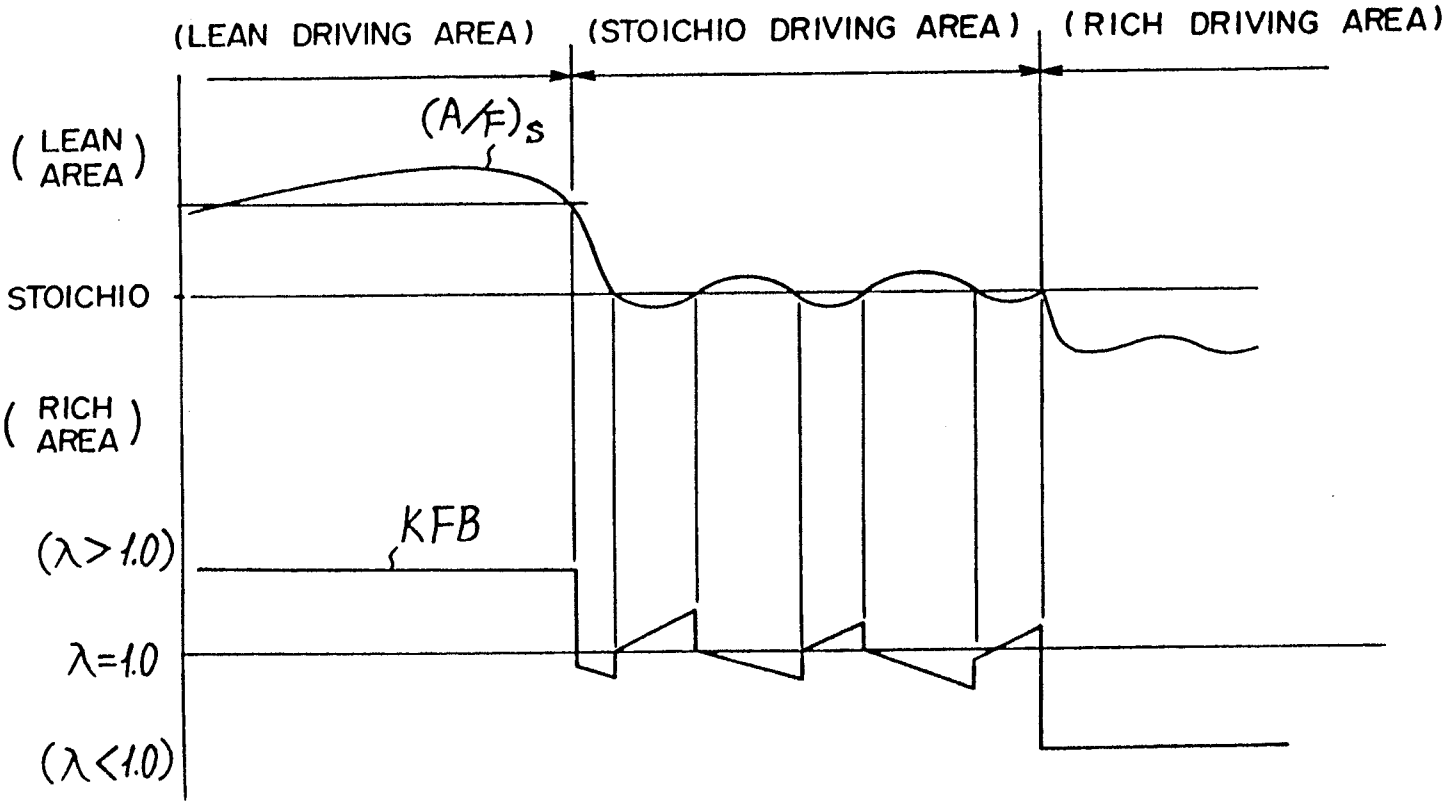
FIG. 3 illustrates waveforms obtained by air fuel ratio control carried out by the device illustrated in FIG. 1.
Figure 4:
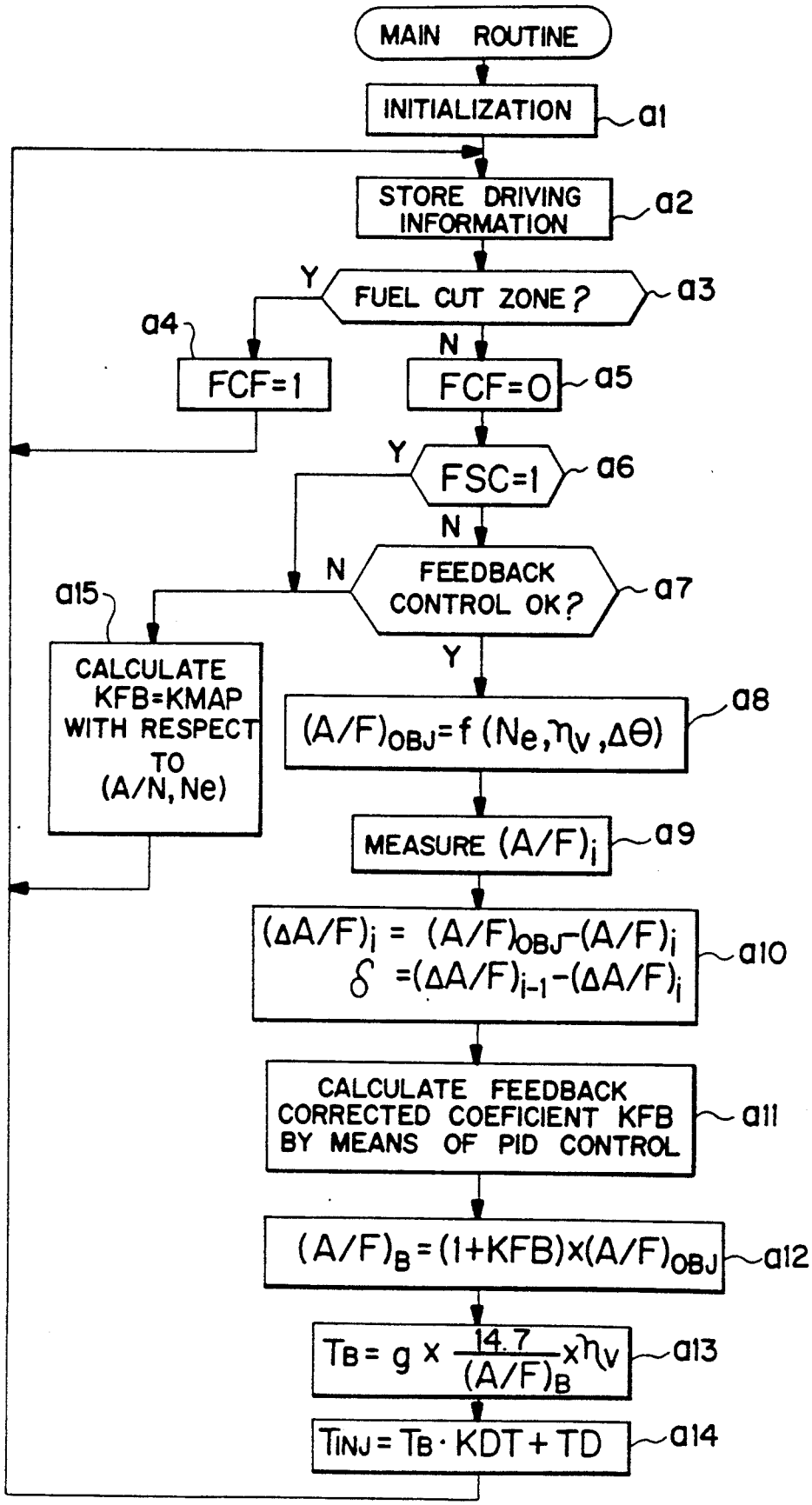
FIG. 4 is a flow chart of a main routine for use in the air fuel ratio control carried out by the device illustrated in FIG. 1.

Particularly in this embodiment, the sensor jam judging unit 107 includes a deviation calculating unit 106 for calculating a deviation $\Delta Af_n$ between the third air fuel ratio $Af_n$ and the sensed air fuel ratio $(A/F)_i$; a large and small judging unit 111 for judging that the deviation $\Delta Af_n$ is larger or smaller than a predetermined value $\epsilon$; a deviation integrating unit 112 for integrating integrated values $E_n$ corresponding to the deviation $\Delta Af_n$; an integrated value processing unit 113 for clearing the integrated value $E_n$ of the deviations when a condition where the deviation is smaller that the predetermined value $\epsilon$ lasts over a predetermined time interval; and a jam judging unit 108 for judging a jam of the large area air fuel ratio sensor 26 when the integrated value $E_n$ exceeds a predetermined value Eo. A description will be made regarding to operations of the air fuel ratio control device for the internal combustion engine with reference to waveforms illustrated in FIG. 3 and control programs illustrated in FIGS. 4 through 8.

When an engine key, which is not shown, is turned on, initial values are stored, at step a1, in a predetermined area where each of the initial values is to be stored to initialize each flag.

At step a2, each area is supplied with current driving information, i.e., the sensed air fuel ratio $(A/F)_i$, the throttle opening signal $\theta_i$, the engine speed signal Ne, the intake air flow signal $A_i$, the water temperature signal wt, the atmospheric temperature Ap, the intake air temperature Ta, and the battery voltage Vb.

Figure 10:
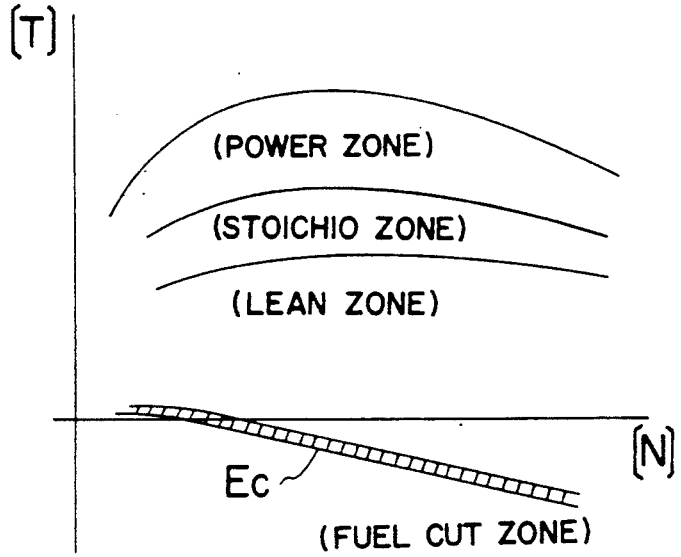
FIG. 10 shows a characteristic curve of an objective air fuel ratio calculating map of a usual engine.

Then, step a3 judges whether or not the current driving area is in the fuel cut area Ec (see FIG. 10). If it is not in the Ec area, a flag FCF is set to return to the step a2. Otherwise, control passes to steps a5 and a6 where the flag FCF is cleared. Then the step a6 judges whether or not a flag FSC is set of which set state indicates the jam of the large area air fuel ratio sensor 26. If this step a6 is negative and the large area air fuel ratio sensor 26 is not jammed, control passes to step a7. If the flag FSC is in the set state indicating the jam of the large area air fuel ratio sensor 26, control passes to step a15. Then, the step a7 judges whether or not feedback control can be carried out, namely, whether or not the activation of the three way catalyst converter 28 and the lean NOx catalyst converter 27 has been completed and whether or not the large area air fuel ratio sensor 26 is activated. When the feedback condition is not satisfied due to any troubles in the large area air fuel ratio sensor 26 or to non-activation of the catalyst, control passes to step a15 where the driving condition is to be considered as being in a non-feedback area. At this step a15, a map corrected coefficient KMAP corresponding to the current driving condition (A/N, Ne) is calculated by a corrected coefficient KMAP calculating map which is not shown. This step a15 is followed by the step a2.

Figure 6:
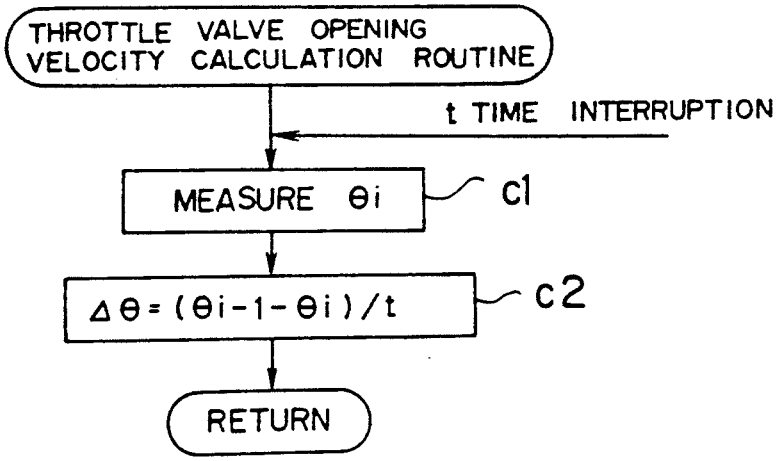
FIG. 6 is a flow chart of a throttle valve opening velocity calculating routine for use in the air fuel ratio control carried out by the device illustrated in FIG. 1.

If the step a7 judges that the feedback control condition is satisfied, this step is followed by step a8 where the objective air fuel ratio $(A/F)_{OBJ}$ is calculated according to the engine speed Ne, the volumetric efficiency $\eta v$ and the throttle opening velocity $\Delta\theta$. The throttle opening velocity $\Delta\theta$ is calculated by the throttle opening velocity calculating map, as illustrated in FIG. 6, activated at interruptions of each predetermined time instant t. In this event, the actual throttle opening $\theta_i$ is stored and the throttle opening velocity $\Delta\theta$ is calculated according to the difference between this value and a previous value $\theta_{i-1}$ at the interruption cycle t to renew the value in the predetermined area. Then, when this value is equal to or larger than a predetermined value $\Delta\theta a$ (for example, over 10° to 12°/sec.), this state is considered as an acceleration state being over calm acceleration so that the excess air ratio $\lambda$ is calculated by the excess air ratio calculating map illustrated in FIG. 9 (*a*) to calculate the objective air fuel ratio $(A/F)_{OBJ}$ corresponding to this value. In this event, the volumetric efficiency $\eta v$ is calculated according to combustion chamber volume which is not shown, the engine speed Ne, the intake air flow $A_i$, the atmospheric pressure Ap, and the atmospheric temperature Ta. The objective air fuel ratio is calculated such that the excess air ratio $\lambda=1$ or $\lambda<1.0$ according to the volumetric efficiency $\eta v$ and the engine speed Ne.

Figure 9A:
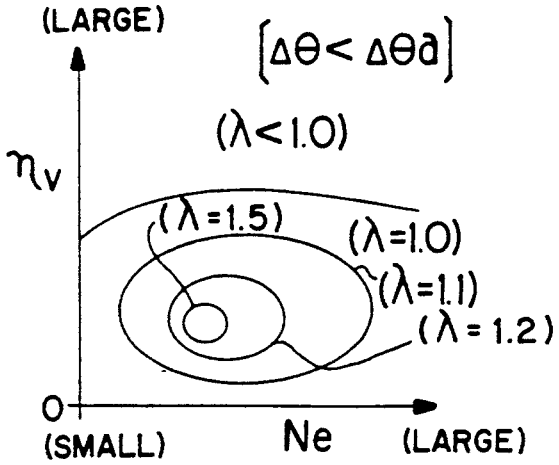
FIG. 9 (*a*) shows a characteristic curve of an excess air ratio calculating map for use at or under calm acceleration on the air fuel ratio control carried out by the device illustrated in FIG. 1.
Figure 9B:
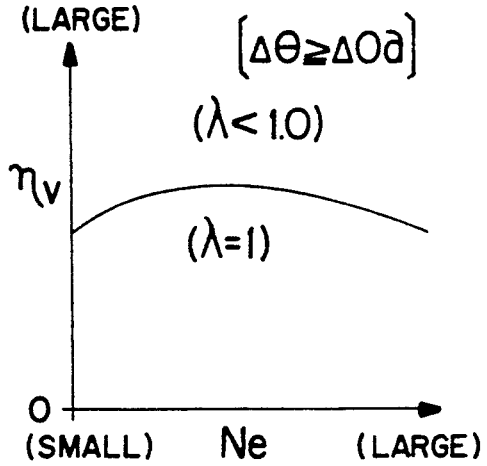

On the other hand, if the throttle opening velocity $\Delta\theta$ is smaller than the predetermined value $\Delta\theta a$, the excess air ratio $\lambda$ is calculated by the excess air ratio calculating map illustrated in FIG. 9 (*b*) to calculated the objective air fuel ratio $(A/F)_{OBJ}$ corresponding to this value. In this event, the volumetric efficiency $\eta v$ is also calculated to calculate the objective air fuel ratio such that $\lambda>1$, for example, $\lambda=1.1$, $\lambda=1.2$ and $\lambda=1.5$ according to the volumetric efficiency $\eta v$ and the engine speed Ne. Now, the excess air ratio $\lambda$ $(=(A/F)_{OBJ}/14.7)$ calculating map illustrated in FIG. 9 (*a*) is used when the throttle valve 18 is in a constant state, in the calm acceleration state and middle and later acceleration states. In other words, this excess air ratio calculating map is used to set the value of $\lambda$ within the range of $\lambda>1.0$ according to the engine speed Ne and the volumetric efficiency $\eta v$ under constant driving, while the value $\lambda$ within the range of $\lambda>1.0$ is also set as in the case of constant driving even on calm acceleration. In addition, this excess air ration calculating map is also used for $\Delta\theta<\Delta\theta a$ even at the latter period with keeping the extreme opening from the middle period except for the earlier period of acceleration. In this event, $\lambda=1.0$ is set with consideration as being acceleration when the throttle opening $\theta_i$ has a relatively large value and the engine speed Ne is saturated. In particular, when the throttle opening $\theta_i$ is in a high loaded area, $\lambda < 1.0$ is set.

After determination of the objective air fuel ratio $(A/F)_{OBJ}$ at the step a8, then step a9 proceeds where the sensed air fuel ratio $(A/F)_i$ is stored. Further, step a10 calculates a deviation $(\Delta A/F)_i$ between the objective air fuel ratio $(A/F)_{OBJ}$ and the actual air fuel ratio $(A/F)_i$ and calculates a difference $\delta$ between $(\Delta A/F)_i$ and a previous deviation $(\Delta A/F)_{i-1}$ to store the values $(\Delta A/F)$; and $\delta$ in a predetermined areas of the memory circuit 213, respectively.

Then, step a11 calculates a feedback corrected coefficient KFB. In this event, a proportional term KP $((\Delta A/F)_i)$ corresponding to the deviation $(\Delta A/F)_i$, a differential term KD $(\delta)$ corresponding to the difference $\delta$, and an integration term $\Sigma KI((A/F)_i)$ corresponding to the deviation $(\Delta A/F)_i$ and time integration are calculated. They all are summed at the feedback area for use in the PID control illustrated in FIG. 3 as the feedback coefficient KFB.

When control passes to step a12, the objective air fuel ration $(A/F)_{OBJ}$ is increasingly corrected by a ratio indicated by the feedback corrected coefficient KFB, namely, $(A/F)_{OBJ}$ is multiplied by (1+KFB) to calculate the set air fuel ration$(A/F)_B$. Then, step a13 multiplies an injector gain g by $14.7/(A/F)_B$ and the volumetric efficiency $\eta v$ to calculate the reference fuel injection amount $T_B$. In addition, at step a14, the reference fuel injection amount $T_B$ is multiplied by the air fuel ratio corrected coefficient KDT corresponding to the water temperature wt, the intake air temperature Ta, and the atmospheric pressure Ap. Further, a voltage corrected coefficient TD is added thereto to calculate the fuel injection time interval $T_{INJ}$. Then, the step a2 is again carried out.

Figure 5:
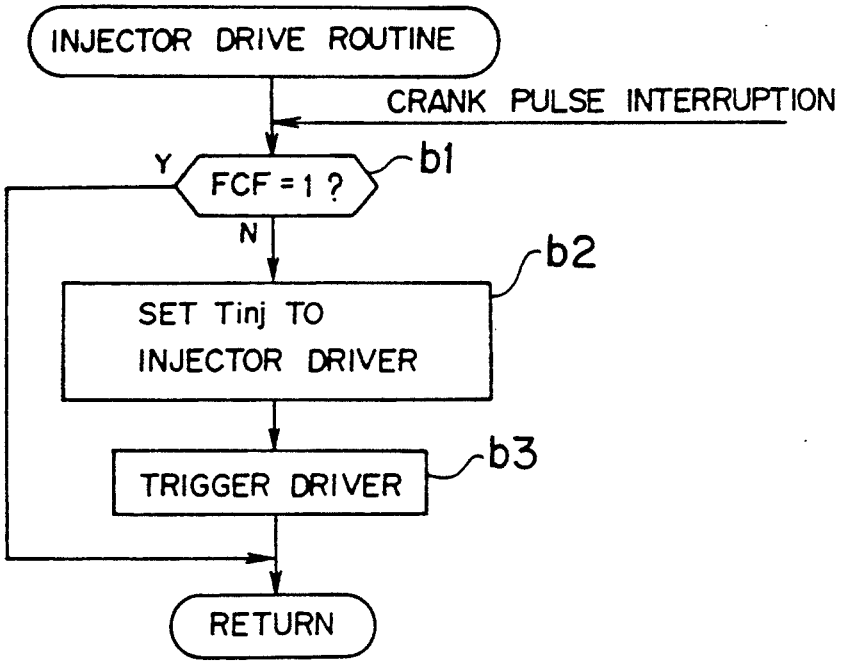
FIG. 5 is a flow chart of an injector actuating routine for use in the air fuel ratio control carried out by the device illustrated in FIG. 1.

Independently of this main routine, the injector proving routine illustrated in FIG. 5 is carried out by each crank angle, where a description will be representatively made as regards to the control for the fuel injection valve 17 as one of them.

In this routine, step b1 judges whether or not the flag FCF is set which represents the fuel cut condition when it is set. If the flag is set, namely, this step b1 judges the fuel cut, control passes to the main routine, and otherwise, control passes to step b2. At the step b2, the latest fuel injection time interval $T_{INJ}$ is set to the injector driver (not shown) connected to the fuel injection valve 17. At the subsequent step b3, this driver is triggered.

Figure 7:
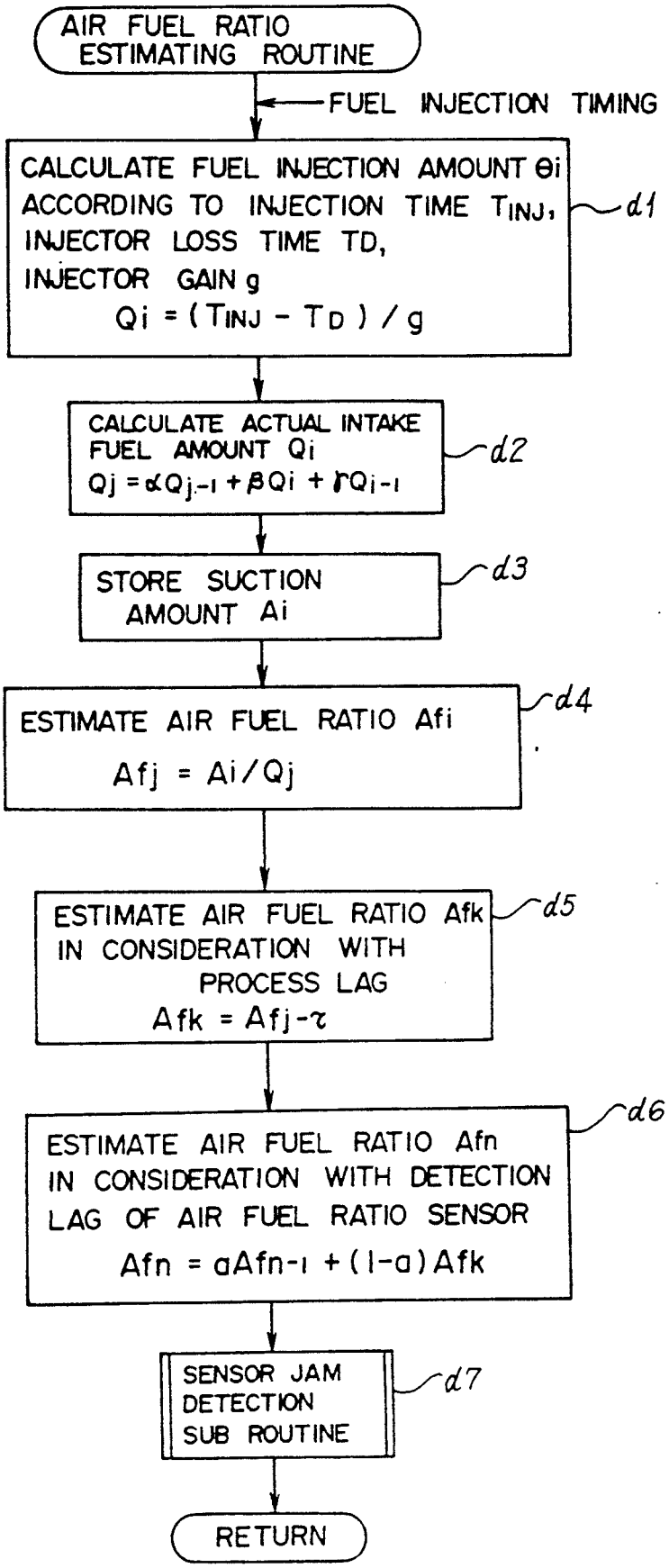
FIG. 7 is a flow chart of an air fuel ratio estimating routine for use in the air fuel ratio control carried out by the device illustrated in FIG. 1.
Figure 8:
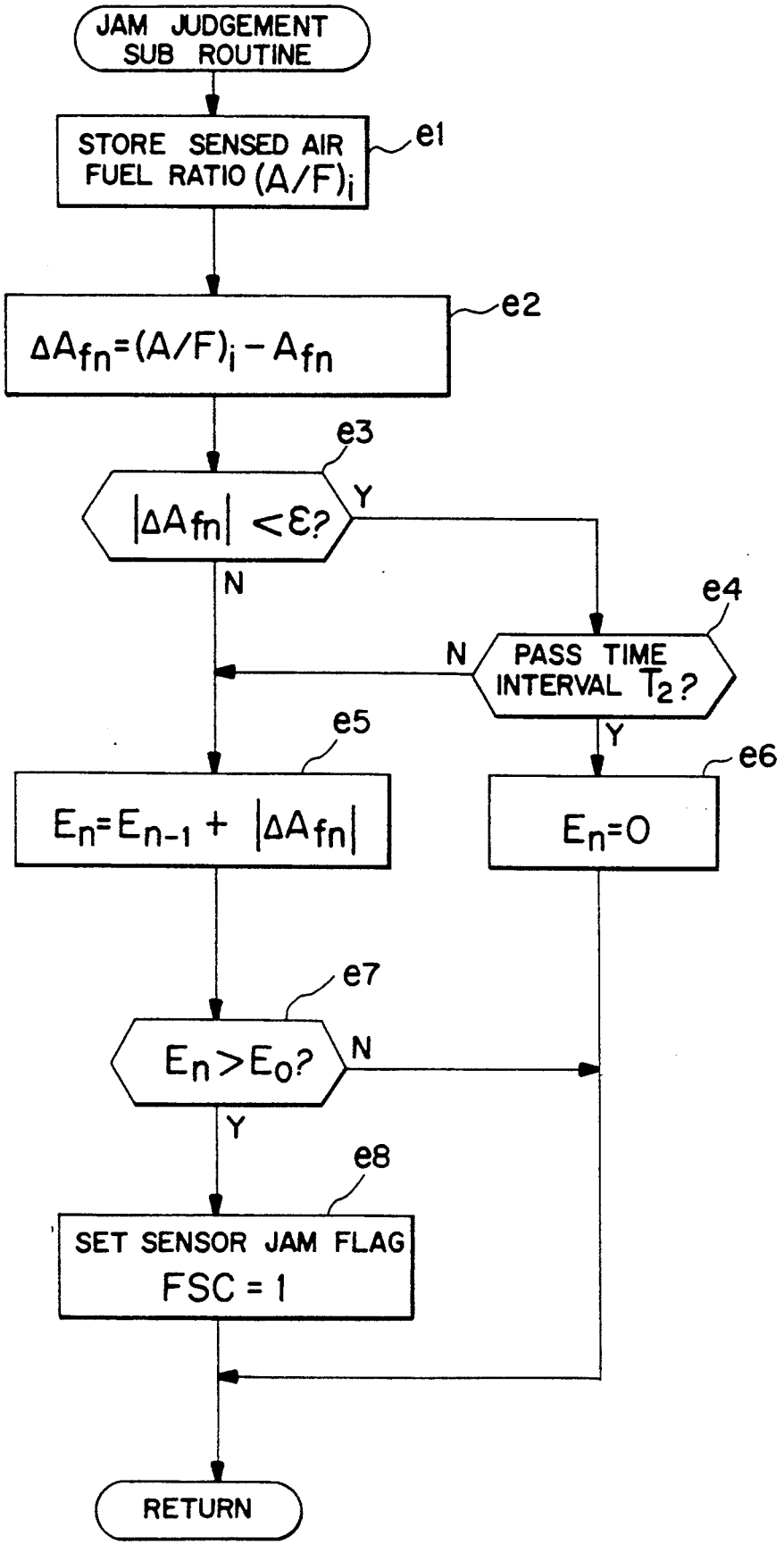
FIG. 8 is a flow chart of a jam judgment sub routine for use in the air fuel ratio control carried out by the device illustrated in FIG. 1.

In addition, on carrying out the main routine, the air fuel ratio estimating routine and the jam judgment routine illustrated in FIGS. 7 and 8 are carried out by interrupting at a fuel injection timing.

When step d1 is carried out, the electronic control device 21 calculates the first air fuel ratio $Af_j$ at a time of suction as the fist estimating unit according to a fuel transportation model Gmm. More particularly, the calculation along this fuel transportation model Gmm is made for calculating an injected fuel amount $Q_i$ injected by the injector by dividing the difference between the injection time interval $T_{INJ}$ and loss time $T_D$ inherent to the injection valve itself by the injector gain (fuel amount converting gain) g. In addition, the fuel amount substantially equal to that presently flowing into the combustion chamber, namely, an actual intake fuel amount $Q_j$ $(=\alpha Q_{j-1}+\beta Q_i+\gamma Q_{i-1})$ is calculated in accordance with the fuel amount $Q_{j-1}$ corresponding to the substantially supplied fuel amount to the combustion chamber at the previous injection and $Q_{i-1}$ at the previous injection. In this event, $\alpha$, $\beta$, and $\gamma$ represent arbitrary constants (where $0 \leqq \alpha \leqq 1$, $0 \leqq \beta \leqq 1$, $0 \leqq \gamma \leqq 1$, and $\alpha+\beta+\gamma=1$). In addition, steps d3 and d4 store the suction air amount Ai on fuel injection, which is divided by the actual intake fuel amount $Q_j$ to calculate the first air fuel ratio $Af_j$ at a time of suction.

Subsequently, at step d5, the electronic control device 21 calculates the second air fuel ratio $Af_k$ as the second estimating unit according to the first air fuel ratio $Af_j$ by a process mode Gpm. More particularly, the present second air fuel ratio $Af_k$ $(=Af_j-\tau)$ is calculated, according to the first air fuel ratio $Af_j$ in consideration with the transportation lag of the gas during each process of the engine, as the previous value by the process lag process $\tau$ (this value is a value in the crank angle unit, set according to an exhaust path volume to the fuel injection valve and a cylinder volume of each engine) of the internal combustion engine for the second air fuel ratio $Af_k$ at the time when the gas was reached to the large area air fuel ratio sensor 26.

Subsequently, at step d6, the electronic control device 21 calculates as the third estimating unit the third air fuel ratio $Af_n$ according to the second air fuel ratio $Af_k$ by a detection model Gsm. More particularly, the third air fuel ratio $Af_n$ at the time when the large area air fuel ratio sensor 26 detects the air fuel ratio is calculated as $Af_n$ $\{=a \times Af_{n-1}+(1-a) \times Af_k\}$ according to the second air fuel ratio $Af_k$ in consideration with the response delay inherent to this large area air fuel ratio sensor 26 up to the exhaust gas reached to the large area air fuel ratio sensor 26 is actually detected. The third estimating unit estimates the present third air fuel ratio $Af_n$ with the previous air fuel ratio $Af_{n-1}$ taking into consideration by the arbitrary constant a (where $0<a<1$) and the present second air fuel ratio $Af_k$ is estimated with the ratio $(1-a)$ taking into consideration.

At step d7, a jam judgment sub routine as illustrated in FIG. 8 is carried out. That is, step e1 calculates the current sensed air fuel ratio $(A/F)_i$ by the large area air fuel ratio sensor 26 to calculate a deviation air fuel ratio $\Delta Af_n$ which is equivalent to a deviation between the current sensed air fuel ratio $(A/F)_i$ and the third air fuel ratio $A/F_n$. In addition, step e3 judges whether or not the absolute value of the deviation air fuel ratio $\Delta A/F_n$ is smaller than the threshold value $\epsilon$. If $|\Delta A/F_n|<\epsilon$, control passes to step e4 to wait the counting of the time interval $T_2$ by the timer Tn. The deviation integrated value $E_n$ is cleared when this time interval $T_2$ passes and affirmative judgment is followed by step e5. At this step e5, the absolute value of the deviation air fuel ratio $\Delta A/F_n$ is added thereto to calculate the deviation calculated value $E_n$ $(=E_{n-1}+|\Delta A/F_n|)$.

Step e7 produces a jam signal by setting a jam flag FSC only when the deviation integrated value $E_n$ is larger than the jam judgment value Eo, otherwise, the control will be returned. In the jam judging sub routine, the jam flag FSC is reset as the ignition key is turned to ON state. Alternative to this, the jam flag FSC may be reset just after the step e6 by setting FSC=0.

In the control device for an internal combustion engine illustrated in FIG. 1, the following effects are exhibited. That is, the electronic control device 21 estimates, in turn, the first air fuel ratio $Af_j$ where the large fuel transportation between the fuel injection and suction is taken into consideration, the second air fuel ratio $Af_k$ where the gas transportation lag from the suction point to the large area air fuel ratio sensor 26 is taken into consideration, and the third air fuel ratio $Af_n$ where the response delay inherent to this large area air fuel ratio sensor 26 itself until the exhaust gas reached to the large area air fuel ratio sensor 26 is actually detected is taken into consideration, to compare the obtained third air fuel ratio sensor $Af_n$ with the sensed air fuel ratio $(A/F)_i$, thereby the jam of this device can be detected. Accordingly, the reliability of the jam judgment for the large area air fuel ratio sensor 26 is improved, resulting in an accurate control for the air fuel ratio.

In particular, the sensor jam judging unit 107 includes the deviation calculating unit 106, the large and small judging unit 111, the deviation integrating unit 112, the integrated value processing unit 113, and the jam judging unit 108 so that in the case where the jam of the large area air fuel ratio sensor 26 is detected when the integrated value $E_n$ of the deviation $\epsilon$ between the third air fuel ratio $Af_n$ and the sensed air fuel ratio $(A/F)_i$, it is possible to eliminate disturbances. Therefore, the reliability of this device is improved which results in an accurate control for the air fuel ratio.

In addition, in the case where the actual intake fuel amount $Q_j$ $(=\alpha Q_{j-1}+\beta Q_i+\gamma Q_{i-1})$ presently flowing into the combustion chamber is calculated by adding the fuel amount $Q_{j-1}$ corresponding to the fuel amount of previous injection actually flowing into the combustion chamber, the fuel amount of the current injection $Q_i$ and the fuel amount of the previous injection $Q_{i-1}$ are summed with the arbitrary constants ($0 \leqq \alpha \leqq 1$, $0 \leqq \beta \leqq 1$, $0 \leqq \gamma \leqq 1$, and $\alpha+\beta+\gamma=1$), it is possible to securely consider the fuel transportation lag between the fuel injection and suction so that the reliability for the first air fuel ratio Afj at the time of suction is more improved.

In addition, in the case where the previous third air fuel ratio $Af_{n-1}$ and the current second air fuel ratio $Af_k$ are summed with the arbitrary constant ($0<a<1$) to calculate the present third air fuel ratio $Af_n$ $(=aAf_{n-1}+(1-a)\cdot Af_k)$, the third air fuel ratio $Af_n$ is less effected by the disturbance. Accordingly, the stability and the reliability for jam judgment of the device are greatly improved.

Industrial Application Field

As mentioned above, in the control device for an internal combustion engine according to the present invention, the reliability for jam judgment of the embodiments of the device is improved and an accurate control for the air fuel ratio can be made. Accordingly, the control device can be effectively applied to a port injection engine for a vehicle or the like. In particular, when the control device is applied to a lean burn engine of which air fuel ratio is controlled by the large area air fuel ratio sensor, the effect thereof is well achieved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A control device for an internal combustion engine comprising:

objective air fuel ratio calculating means for calculating an objective air fuel ratio depending on a driving condition;

a large area air fuel ratio sensor disposed in an exhaust system;

fuel amount calculating means for calculating a fuel amount in accordance with a difference between a measurement air fuel ratio detected by said large area air fuel ratio sensor and the objective air fuel ratio;

controlling means for supplying an actuating instruction signal to a fuel injector depending on said fuel amount;

air fuel ratio estimating means including, a first estimating unit for estimating a first air fuel ratio on intake in consideration with a fuel transportation lag between fuel injection and suction in accordance with said actuating instruction signal, a second estimating unit for estimating a second air fuel ratio at a time when the gas arrives to the large area air fuel ratio sensor in consideration with a transportation lag of the gas between the process of the engine between suction and arrival to said large area air fuel ratio sensor in accordance with said first fuel ratio, and a third estimating unit for estimating a third air fuel ratio at a time when said large area fuel ratio sensor detects said first, second and third air fuel ratios in consideration with a response lag which is inherent to the large area air fuel ratio sensor in accordance with said second air fuel ratio; and sensor jam judging means for judging a jam of said large area air fuel ratio sensor by comparing said third air fuel ratio with the measurement air fuel ratio.

2. A control device for an internal combustion engine as claimed in claim 1, wherein said sensor jam judging means comprises:

a deviation calculating unit for calculating a deviation between the third air fuel ratio estimated by said air fuel ratio estimating means and the measurement air fuel ratio detected by said large area air fuel ratio sensor;

a large and small judging unit for judging whether the deviation is larger or smaller than a predetermined value;

a deviation integrating unit for integrating values corresponding to the deviation;

an integrated value processing unit for clearing an integrated value of the deviation when a condition where said deviation is determined by said large and small judging unit as being smaller than the predetermined value lasts over a predetermined time interval; and a jam judging unit for judging a jam of the large area air fuel ratio sensor when said integrated value exceeds a predetermined value.

3. A control device for an internal combustion engine as claimed in claim 1, wherein said first estimating unit in said air fuel ratio estimating means further comprises an intake fuel amount calculating unit for calculating an actual intake fuel amount according to the fuel amount of additionally injected fuel which actually flows into a chamber and the fuel amount of fuel adhered on the internal surface of the chamber which actually flows into a chamber, said first air fuel ratio on suction is estimated in accordance with said fuel amount of additionally injected fuel which actually flows into a chamber and the intake air flow on fuel injection.

4. A control device for an internal combustion engine as claimed in claim 3, wherein said intake fuel amount calculating unit calculates the fuel amount substantially supplied to the combustion chamber which takes into consideration a fuel amount corresponding to that adhered on the internal surface of the suction pipe at the previous fuel injection.

5. A control device for an internal combustion engine as claimed in claim 4, wherein said intake fuel amount calculating unit calculates the fuel amount adhered to the internal surface of the suction pipe on previous injection according to the actual fuel amount on previous injection and the fuel amount on previous injection.

6. A control device for an internal combustion engine as claimed in claim 5, wherein said intake fuel amount calculating unit calculates the fuel amount substantially equal to that presently flowing into the combustion chamber, namely, said actual intake fuel amount in accordance with the equation:

$$Q_j=\alpha Q_{j-1}+\beta Q+\gamma Q_{i-1},$$

where the actual intake fuel amount on present injection is $Q_j$, the actual intake fuel amount on previous injection is $Q_{j-1}$, the injected fuel amount on present injection is $Q_i$, the injected fuel amount on previous injection is $Q_{i-1}$, and arbitrary constants are $\alpha$, $\beta$ and $\gamma$ (where $0\leqq\alpha\leqq1$, $0\leqq\beta\leqq1$, $0\leqq\gamma\leqq1$, and $\alpha+\beta+\gamma=1$).

7. A control device for an internal combustion engine as claimed in claim 1, wherein the third estimating unit of said air fuel ratio estimating means estimates the third air fuel ratio in consideration with the previous estimated result.

8. A control device for an internal combustion engine as claimed in claim 1, wherein the third estimating unit of said air fuel ratio estimating means estimates the current third air fuel ratio in consideration with the equation:

$$Af_n+a\times Af_{n-1}+(1-a)\times Af_k$$

where the current third air fuel ratio is $Af_n$, the previous third air fuel ratio is $Af_{n-1}$, the current second air fuel ratio is $Af_k$, and an arbitrary constant is a (where $0<a<1$).

9. A method for controlling a fuel injector in an internal combustion engine, comprising the steps of:

(a) calculating an objective air fuel ratio depending on a driving condition;

(b) detecting a measurement air fuel ratio by a large area air fuel ratio sensor disposed in an exhaust system;

(c) calculating a fuel amount in accordance with a difference between said measurement air fuel ratio detected at said step (b) and said objective air fuel ratio calculated at said step (a);

(d) supplying an actuating instruction signal to the fuel injector depending on said fuel amount calculated at said step (c);

(e) estimating a first air fuel ratio on intake in consideration with a fuel transportation lag between fuel injection and suction in accordance with said actuating instruction signal supplied at said step (d);

(f) estimating a second air fuel ratio at a time when the gas arrives to said large area air fuel ratio sensor in accordance with said first air fuel ratio;

(g) estimating a third air fuel ratio at a time when said large area air fuel ratio sensor detects said first, second and third air fuel ratios in consideration with a response lag which is inherent to said large area air fuel ratio sensor in accordance with said second air fuel ratio; and (h) judging a jam of said large area air fuel ratio sensor by comparing said third air fuel ratio with said measurement air fuel ratio.

10. A method for controlling a fuel injector in an internal combustion engine as claimed in claim 9, wherein said step (h) comprises the steps of:

(h) (1) calculating a deviation between said third air fuel ratio estimated at said step (g) and said measurement air fuel ratio detected at said step (b);

(h) (2) judging whether said deviation is larger or smaller than a predetermined value;

(h) (3) integrating values corresponding to said direction;

(h) (4) clearing an integrated value of said deviation when a condition where said deviation is judged at said step (h) (2) as being smaller than said predetermined value lasts over a predetermined time interval; and (h) (5) judging a jam of said large area air fuel ratio sensor when said integrated value exceeds a predetermined value.

11. A method for controlling a fuel injector in an internal combustion engine as claimed in claim 9, wherein said step (e) further comprises the step of calculating an actual intake fuel amount by an intake fuel amount calculating unit according to the fuel amount of additionally injected fuel which actually flows into a chamber and the fuel amount of fuel adhered on the internal surface of the chamber which actually flows into a chamber wherein said first air fuel ratio and suction is estimated in accordance with said fuel amount of additionally injected fuel which actually flows into a chamber and the intake air flow on fuel injection.

12. A method for controlling a fuel injector in an internal combustion engine as claimed in claim 11, wherein said intake fuel amount calculating unit calculates the fuel amount supplied to the combustion chamber which takes into consideration a fuel amount corresponding to that adhered on the internal surface of the suction pipe at the previous fuel injection.

13. A method for controlling a fuel injector in an internal combustion engine as claimed in claim 12, wherein said intake fuel amount calculating unit calculates the fuel amount adhered to the internal surface of the suction pipe on previous injection according to the actual fuel amount on previous injection and the fuel amount on previous injection.

14. A method for controlling a fuel injector in an internal combustion engine as claimed in claim 13, wherein said intake fuel amount calculating unit calculates the fuel amount substantially equal to that presently flowing into the combustion chamber, namely, said actual intake fuel amount in accordance with the equation:

$$Q_j=\alpha Q_{j-1}+\beta Q_i+\gamma Q_{i-1},$$

where the actual intake fuel amount on present injection is $Q_j$, the actual intake fuel amount on previous injection is $Q_{j-1}$, the injected fuel amount on present injection is $Q_i$, the injected fuel amount on previous injection is $Q_{i-1}$, and arbitrary constants are $\alpha$, $\beta$ and $\gamma$ (where $0\leqq\gamma\leqq1$, $0\leqq\beta\leqq1$, $0\leqq\gamma\leqq1$, and $\alpha+\beta+\gamma=1$).

15. A method for controlling a fuel injector in an internal combustion engine as claimed in claim 9, wherein said step (g) estimates said third air fuel ratio in consideration with the previous estimated result.

16. A method for controlling a fuel injector in an internal combustion engine as claimed in claim 9, wherein said step (g) estimates the current third air fuel ratio in consideration with the equation:

$$Af_n + a \times Af_{n-1} + (1-a) \times Af_k$$

where the current third air fuel ratio is $Af_n$, the previous third air fuel ratio is $Af_{n-1}$, the current second air fuel ratio is $Af_k$, and an arbitrary constant is a (where $0 < a < 1$).

* * * * *